US009157702B2

(12) United States Patent
Elkayam et al.

(10) Patent No.: US 9,157,702 B2
(45) Date of Patent: Oct. 13, 2015

(54) MUNITION GUIDANCE SYSTEM AND METHOD OF ASSEMBLING THE SAME

(75) Inventors: Ami Elkayam, Kiryat-Bialik (IL); Zeev Azar, Zikhron-Yaakov (IL)

(73) Assignee: Elbit Systems Ltd., Haifa (IL)

( * ) Notice: Subject to any disclaimer, the term of this patent is extended or adjusted under 35 U.S.C. 154(b) by 0 days.

(21) Appl. No.: 14/233,761

(22) PCT Filed: Jul. 18, 2012

(86) PCT No.: PCT/IL2012/050255

§ 371 (c)(1),
(2), (4) Date: Jan. 20, 2014

(87) PCT Pub. No.: WO2013/011510

PCT Pub. Date: Jan. 24, 2013

(65) Prior Publication Data

US 2014/0158814 A1 Jun. 12, 2014

(30) Foreign Application Priority Data

Jul. 19, 2011 (IL) ..... 214191

(51) Int. Cl.

| | |
|---|---|
| ***F41G 7/20*** | (2006.01) |
| ***F41G 7/22*** | (2006.01) |
| ***F42B 15/01*** | (2006.01) |
| ***F42B 33/00*** | (2006.01) |
| *F41G 7/00* | (2006.01) |
| *F42B 15/00* | (2006.01) |

(52) U.S. Cl.
CPC .. *F41G 7/22* (2013.01); *F41G 7/20* (2013.01); *F42B 15/01* (2013.01); *F42B 33/00* (2013.01)

(58) Field of Classification Search
CPC ..... F42B 15/01; F42B 33/00; F41G 7/20; F41G 7/22; F41G 7/34; F41G 7/343; F41G 7/346; F41G 7/36
USPC ..... 244/3.1, 3.15–3.3; 89/1.51, 1.54, 1.8, 89/1.809, 1.81, 1.816; 102/382, 384, 473, 102/489, 501, 503; 86/51
See application file for complete search history.

(56) References Cited

U.S. PATENT DOCUMENTS

| | | | | | |
|---|---|---|---|---|---|
| 4,175,720 | A | * | 11/1979 | Craig | 244/3.28 |
| 4,471,923 | A | * | 9/1984 | Hoppner et al. | 244/3.27 |
| 4,533,094 | A | * | 8/1985 | Geis et al. | 244/3.22 |
| 4,709,877 | A | * | 12/1987 | Goulding | 244/3.28 |

(Continued)

FOREIGN PATENT DOCUMENTS

| | | |
|---|---|---|
| FR | 2845763 | 4/2004 |
| WO | WO 2006/088687 | 8/2006 |
| WO | WO 2013/011510 | 1/2013 |

OTHER PUBLICATIONS

International Preliminary Report on Patentability Dated Jan. 30, 2014 From the International Bureau of WIPO Re. Application No. PCT/IL2012/050255.

(Continued)

*Primary Examiner* — Bernarr Gregory

(57) ABSTRACT

A munition guidance system is disclosed. The system comprises a generally tubular enclosure, having an internal cavity adapted for receiving a munition, wherein an outer diameter of the enclosure is at most the largest outer diameter of the munition; and a processing and control unit enclosed within the enclosure and being configured for controlling guidance wings so as to maneuver the munition while flying.

18 Claims, 5 Drawing Sheets

(56) References Cited

U.S. PATENT DOCUMENTS

| | | | | |
|---|---|---|---|---|
| 4,728,058 | A * | 3/1988 | Brieseck et al. | 244/3.28 |
| 5,103,734 | A * | 4/1992 | Arnaud et al. | 102/489 |
| 5,114,095 | A * | 5/1992 | Schroppel et al. | 244/3.28 |
| 6,056,237 | A * | 5/2000 | Woodland | 244/3.15 |
| 6,073,880 | A * | 6/2000 | Voigt et al. | 244/3.28 |
| 6,227,096 | B1 * | 5/2001 | Thomas | 89/1.54 |
| 6,260,797 | B1 * | 7/2001 | Palmer | 102/501 |
| 6,314,886 | B1 * | 11/2001 | Kuhnle et al. | 244/3.28 |
| 6,427,574 | B1 * | 8/2002 | Callahan | 89/1.81 |
| 6,880,780 | B1 * | 4/2005 | Perry et al. | 244/3.27 |
| 7,004,425 | B2 * | 2/2006 | Okada et al. | 244/3.29 |
| 7,163,176 | B1 * | 1/2007 | Geswender et al. | 244/3.27 |
| 7,175,131 | B2 * | 2/2007 | Dodu et al. | 244/3.24 |
| 7,533,849 | B2 * | 5/2009 | Zemany et al. | 244/3.16 |
| 8,115,149 | B1 * | 2/2012 | Manole et al. | 244/3.24 |
| 8,319,164 | B2 * | 11/2012 | Martinez | 244/3.27 |
| 8,674,278 | B2 * | 3/2014 | Buckland et al. | 244/3.27 |
| 2010/0288870 | A1 | 11/2010 | Geswender et al. | |

OTHER PUBLICATIONS

International Search Report and the Written Opinion Dated Nov. 13, 2012 From the International Searching Authority Re. Application No. PCT/IL2012/050255.

Office Action Dated Jun. 16, 2014 From the Israel Patent Office Re. Application No. 214191 and Its Translation Into English.

Communication Pursuant to Article 94(3) EPC Dated Jun. 22, 2015 From the European Patent Office Re. Application No. 12750825.7.

* cited by examiner

MUNITION GUIDANCE SYSTEM AND METHOD OF ASSEMBLING THE SAME

RELATED APPLICATION

This application is a National Phase of PCT Patent Application No. PCT/IL2012/050255 having International filing date of Jul. 18, 2012, which claims the benefit of priority of Israel Patent Application No. 214191 filed on Jul. 19, 2011. The contents of the above applications are all incorporated by reference as if set forth herein in their entirety.

FIELD AND BACKGROUND OF THE INVENTION

The present invention, in some embodiments thereof, relates to guided munition and, more particularly, but not exclusively, to a munition guidance system and method of assembling the same.

A variety of means are known for controlling the flight of a projectile weapon subsequent to launch. Many such means include sophisticated inertial guidance mechanisms capable of accurately monitoring acceleration of the projectile weapon and thereby keeping track of the location of the projectile.

For example, U.S. Pat. No. 4,579,298 discloses means to axially deflect the nose of a projectile, using solenoid means disposed in the body of a rocket; U.S. Pat. No. 3,141,411 uses a plurality of incremental auxiliary charges to deflect a projectile; U.S. Pat. No. 4,374,577 discloses asymmetrical movable projectile nose and means which rotate the asymmetrical nose surface as required to deflect the path of the projectile; U.S. Pat. No. 4,444,119 discloses a projectile having a plurality of impulse generating explosive charges arranged according to translate the projectile laterally during flight; U.S. Pat. No. 4,672,753 discloses a sensor which detects the passage of electrolyte fluid for indicating a change in attitude of the sensor; and U.S. Pat. No. 4,628,729 teaches rotational acceleration sensors and static angle sensors for sensing the attitude of a vehicle.

Additional background art includes U.S. Pat. Nos. 4,899,956 and 5,943,009; IL Patent Nos. 129106 and 133966; International Publication Nos. WO03027599, WO05015115, WO2006088687, WO2007089243, WO2010016967, WO2010083517 and WO8202765; and U.S. Published Application No. 20100044495.

SUMMARY OF THE INVENTION

According to an aspect of some embodiments of the invention there is provided a munition guidance system. The system comprises a generally tubular enclosure, having an internal cavity adapted for receiving a munition, wherein an outer diameter of the enclosure is at most the largest outer diameter of the munition; and a processing and control unit enclosed within the enclosure and being configured for controlling guidance wings so as to maneuver the munition while flying.

According to some embodiments of the invention the system is in a separate packing from the munition.

According to some embodiments of the invention the system comprises an adaptor device having a protruding member compatible with a recess in the munition and an outer surface compatible with an inner surface of the enclosure.

According to some embodiments of the invention the system comprises the guidance wings.

According to some embodiments of the invention the guidance wings are enclosed within the enclosure and configured for being erected outwardly from the enclosure.

According to some embodiments of the invention the processing and control unit is configured for controlling erection and/or rotation of the wings.

According to some embodiments of the invention the system comprises a target identification unit for identifying a target.

According to some embodiments of the invention the processing and control unit is configured for signaling the wings to maneuver the munition during flight responsively to target identification data received from the target identification unit.

According to some embodiments of the invention the processing and control unit is configured for erecting the wings subsequently to positive identification signal received from the target identification unit.

According to some embodiments of the invention the target identification unit comprises an optical identification unit.

According to some embodiments of the invention the system comprises a global positioning system (GPS) for determining a location of the munition during flight, the GPS being associated with a data interface for receiving from an external source location data pertaining to an expected location of a target, and being configured for calculating expected relative location data based on the location of the munition and the expected location of the target.

According to some embodiments of the invention the processing and control unit is configured for signaling the wings to erect and maneuver the munition during flight toward the target based on the relative location data.

According to some embodiments of the invention the system comprises a plurality of guidance wings enclosed within the enclosure and configured for being erected outwardly from the enclosure; a target identification unit for identifying a target and transmitting relative location data pertaining to at least a direction to a target; and a global positioning system (GPS) for determining a location of the munition during flight, the GPS being associated with a data interface for receiving from an external source location data pertaining to an expected location of a target, and being configured for calculating expected relative location data based on the location of the munition and the expected location of the target. According to some embodiments of the invention the processing and control unit is configured for signaling the wings to erect and maneuver the munition during flight responsively to relative location data received from at least one of the target identification data and the GPS.

According to some embodiments of the invention the processing and control unit is configured for selecting a single guidance scenario from the group consisting of: a first guidance scenario in which the erecting and the maneuvering is responsive to relative location data received from the target identification unit, and a second guidance scenario in which the erecting and the maneuvering is responsive to relative location data received from the GPS but not from the target identification unit.

According to some embodiments of the invention the processing and control unit is configured for selecting the first guidance scenario if a positive identification signal is received from the target identification unit within a predetermined time of flight.

According to some embodiments of the invention the processing and control unit is configured for selecting the first guidance scenario if a positive identification signal is received from the target identification unit while an estimated distance to the target is above a predetermined distance threshold.

According to some embodiments of the invention the processing and control unit is configured for selecting the first guidance scenario if a positive identification signal is received from the target identification unit while an estimated remaining time until impact is above a predetermined impact time threshold.

According to some embodiments of the invention the system comprises an inertial measurement unit (IMU) configured for sensing kinematic data pertaining to motion of the munition, wherein the processing and control unit is configured for processing the kinematic data to estimate a location of the munition during flight.

According to some embodiments of the invention the enclosure comprises an opening for allowing an operator to access a safety element in the munition.

According to some embodiments of the invention the enclosure comprises a collapsing member for triggering an impact fuse in the munition upon impact.

According to some embodiments of the invention the processing and control unit is configured for detonating a warhead in the munition when the munition approaches a target.

According to an aspect of some embodiments of the present invention there is provided a method of assembling a guided munition, comprising mounting the system described herein on a munition.

According to some embodiments of the invention the munition is a mortar shell.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

Implementation of the method and/or system of embodiments of the invention can involve performing or completing selected tasks manually, automatically, or a combination thereof. Moreover, according to actual instrumentation and equipment of embodiments of the method and/or system of the invention, several selected tasks could be implemented by hardware, by software or by firmware or by a combination thereof using an operating system.

For example, hardware for performing selected tasks according to embodiments of the invention could be implemented as a chip or a circuit. As software, selected tasks according to embodiments of the invention could be implemented as a plurality of software instructions being executed by a computer using any suitable operating system. In an exemplary embodiment of the invention, one or more tasks according to exemplary embodiments of method and/or system as described herein are performed by a data processor, such as a computing platform for executing a plurality of instructions. Optionally, the data processor includes a volatile memory for storing instructions and/or data and/or a non-volatile storage, for example, a magnetic hard-disk and/or removable media, for storing instructions and/or data. Optionally, a network connection is provided as well. A display and/or a user input device such as a keyboard or mouse are optionally provided as well.

BRIEF DESCRIPTION OF THE DRAWINGS

Some embodiments of the invention are herein described, by way of example only, with reference to the accompanying drawings. With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

In the drawings.

DESCRIPTION OF SPECIFIC EMBODIMENTS OF THE INVENTION

Figure 1:
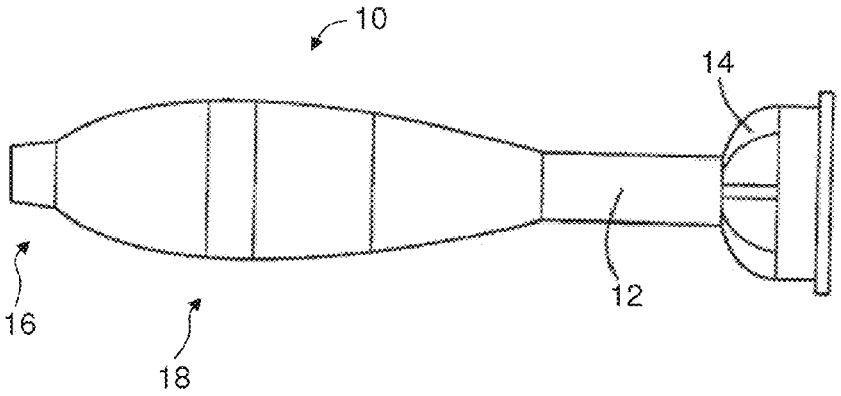
FIG. 1 is a schematic illustration of a munition.

The present invention, in some embodiments thereof, relates to guided munition and, more particularly, but not exclusively, to a munition guidance system and method of assembling the same.

Before explaining at least one embodiment of the invention in detail, it is to be understood that the invention is not necessarily limited in its application to the details of construction and the arrangement of the components and/or methods set forth in the following description and/or illustrated in the drawings and/or the Examples. The invention is capable of other embodiments or of being practiced or carried out in various ways.

Referring now to the drawings, FIG. 1 is a schematic illustration of a munition 10 which can be any munition including, without limitation, a mortar shell, a rocket or any other munition suitable for artillery use. Preferably, munition 10 is a barrel-expelled munition. In some embodiments of the present invention munition 10 is an indirect-fire munition. Munition 10 comprises a nose 16, a main body section 18, a tail 12 and fins 14 at the rear end of tail 12. Fins 14 serve for stabilizing the flight of munition 10. Nose 16 typically includes a fuse component to cause detonation, e.g., upon impact. In the schematic drawing of FIG. 1 nose 16 is the fuse itself.

It is expected that during the life of a patent maturing from this application many relevant weapons will be developed and the scope of the terms munition, barrel-expelled munition and indirect-fire munition is intended to include all such new technologies a priori.

When firing munition 10 at distant targets, the trajectory information needed for correctly aiming the munition to hit the target is traditionally computed from ballistic calculations and from data representative of the target position. However, even with radar sighting devices and high-speed computerized control, the chances of successfully hitting a moving target are far from being sufficient. Conventional techniques for in-flight maneuvering of munitions are either costly or technologically difficult to employ, since they require modifying the munition itself. For these reasons, these mechanisms have met with little commercial acceptance. The present inventors have identified the commercial need for a munition guidance system which can be used as an add-on kit to an existing, unmodified, munition.

Figure 2:
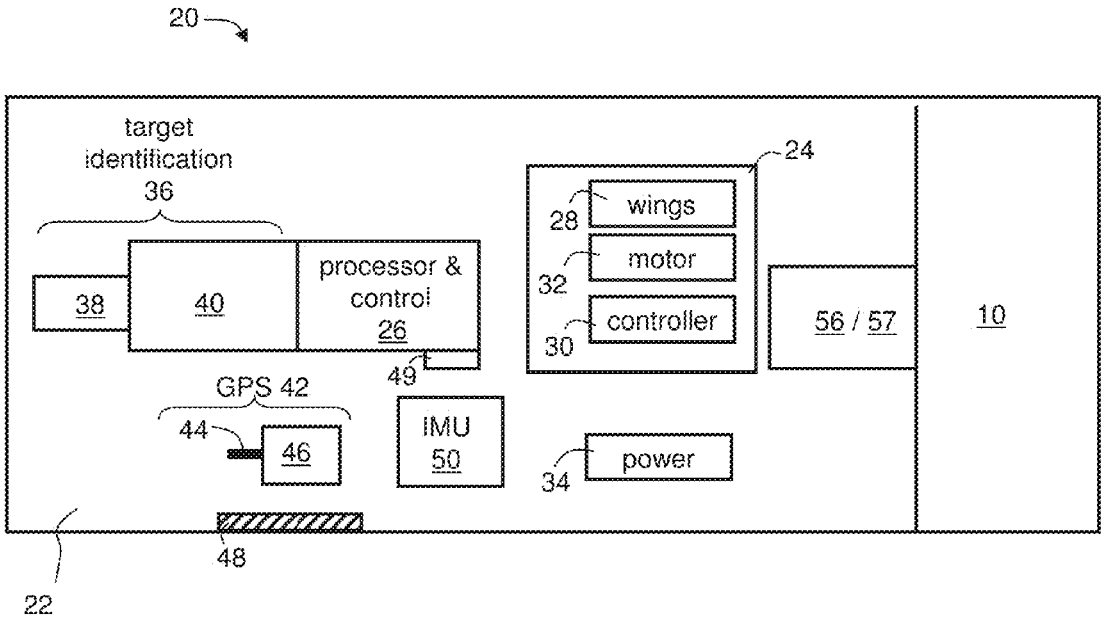
FIG. 2 is a schematic block diagram of guidance system, according to some embodiments of the present invention.

The present inventors have therefore devised a munition guidance system 20 which can be used as an add-on kit to an existing munition. FIG. 2 is a schematic block diagram of guidance system 20, according to some embodiments of the present invention. System 20 is provided as a kit to be mounted onto a munition, such as, but not limited to, munition 10 described above. Preferably, but not necessarily, system 20 is provided in a separate packaging from the munition.

System 20 comprises a generally tubular enclosure 22 which encloses a guiding unit 24 and a processing and control unit 26. Enclosure 22, as well as the preferred connection to munition 10 is described hereinafter.

In some embodiments of the present invention guiding unit 24 comprises a plurality of guidance wings 28 which are optionally and preferably configured for being erected outwardly from enclosure 22. Alternatively, the wings can be provided as a separate kit. Processing and control unit 26 provide the function of a computer and is configured for controlling erection and/or rotation of wings 28, e.g., via a guidance controller 30, so as to maneuver munition 10 while flying. The erection and other motions of wings 28 are optionally and preferably established by means of a motor 32, for example, an electrical motor. A power source 34 provides the voltage required for the operation of controller 30, motor 32 and unit 26.

In some embodiments, system 20 comprises a collapsing member 76 for triggering an impact fuse in munition 10 upon impact.

In various exemplary embodiments of the invention system 20 comprises a target identification unit 36 for identifying a target. Processing and control unit 26 is preferably configured for signaling wings 28 of guiding unit 24 to maneuver munition 10 during flight responsively to target identification data received from target identification unit 36. In some embodiments, processing and control unit 26 signals controller 30 of guiding unit 24 to erect wings 28 subsequently to a positive identification signal received from identification unit 36. A preferred guidance procedure which can be employed by processing and control unit 26 is described hereinafter. Unit 36 can feature any type of target identification, including, without limitation, radar identification, optical identification, imaging identification or any other measure allowing target identification and navigating the unit to the target.

For example, when unit 36 comprises an optical identification unit, an optical mark can be generated or placed on the surface of the target, e.g., by illuminating the target by means of a stand off illuminator which projects a beam, such as a laser beam or the like, onto the target. Unit 36 can then acquire the target by detecting the illumination coming from the mark. Unit 36 preferably includes optics 38 and a sensor or sensor array 40 which in some embodiments are assembled together as an integral unit. Sensor or sensor array 40, which preferably consists of a plurality of photodetectors, is centered on the optical axis of optics 38.

Unit 36 communicates with processing and control unit 26, and provides input data to a target module (not shown) which is part of unit 26.

In various exemplary embodiments of the invention system 20 comprises a global positioning system (GPS) 42 for determining a location of munition 10 during flight. GPS 42 preferably comprises an antenna 44, and processor 46 which provide position and optionally and preferably also altitude and/or velocity data in a suitable navigational coordinates (e.g., earth referenced coordinates). Any number, configuration, and/or orientation of antennas can be included in system 20. For example, each antenna can be configured and oriented to receive GPS signals from a different direction or range of directions (e.g., each antenna pattern having a lobe directed toward a different direction or range of directions). GPS suitable for the present embodiments are commercially available, for example, from BAE Systems (e.g., SINAV™ INS/GPS), or SIRF-III™.

GPS 42 is preferably associated with a data interface 48 for receiving from an external source (not shown) location data pertaining to an expected location of the target. Data interface 48 can be of any type that allows location data to be entered. For example, in some embodiments data interface is a socket adapted for receiving a compatible data cable having a compatible plug. The socket can be of any type, including, without limitation, an integrated device electronics (IDE) interface, a small computer system interface (SCSI), serial attached SCSI (SAS), secure digital input/output (SDIO) interface, universal serial bus (USB) interface, multimedia card (MMC) interface, high-speed multimedia card (HS-MMC) interface, advanced technology attachment (ATA) interface, Serial ATA (SATA) interface and an optical fiber interface. Data interface 48 can alternatively or additionally be implemented as an interactive user interface for allowing the operator to enter the data manually. Thus, for example, data interface 48 can include a keyboard and a display, a touch screen or the like.

GPS 42 optionally and preferably calculates expected relative location data based on the location of munition 10 and the expected location of the target as received from data interface 48, and transmits the calculated data to processing and control unit 26. Alternatively, processing and control unit 26 can receive from GPS 42 data pertaining to the location of munition 10, and from data interface 48 data pertaining to the expected location of the target, in which case the calculation of expected relative location is done by unit 26.

Processing and control unit 26 optionally and preferably signals wings 28 to erect and maneuver munition 10 during flight toward the target based on the calculated relative location data.

In various exemplary embodiments of the invention system 20 comprises an inertial measurement unit (IMU) 50 configured for sensing kinematic data pertaining to the motion of munition 10. An inertial measurement unit, as known in the art is a closed system that detects changes in angular rate and velocity. Optionally and preferably IMU 50 is a so-called "extended IMU" that can also provide additional kinematic and/or position data, including, without limitation, velocity, position, yaw, pitch and roll. In some embodiments of the present invention IMU 50 features inherent error correction.

In various exemplary embodiments of the invention IMU 50 is Micro Electro-Mechanical System (MEMS) based IMU in which MEMS gyros and MEMS accelerators provide high-accuracy attitude, azimuth, relative position, and velocity. IMU 50 is optionally and preferably housed in a protective structure that allows all the components of IMU 50 (electrical and mechanical) to survive high-G environments with little or no potting and remain precisely aligned in all three dimensions to measure range, pitch, and yaw during movement. A representative example of a MEMS based IMU suitable for the present embodiments including, without limitation, Analog Devices ADIS 16360 Six Degrees of Freedom Inertial Sensor.

Processing and control unit 26 can be configured for processing the data received from IMU 50 so as to estimate the location and the inertial orientation of munition 10 during flight. When system 20 comprises both GPS 42 and IMU 50, data from GPS 42 is optionally and preferably used by unit 26 to correct for long-term drift in the position as determination by the data from IMU 50.

A preferred guidance procedure which can be employed by processing and control unit 26 will now be described. In the presently preferred embodiment, processing and control unit 26 is configured for signaling wings 28 (e.g., via guidance controller 30) to erect and maneuver munition 10 during flight responsively to relative location data received from at least one of target identification unit 36 and GPS 42 optionally also in combination with kinematic data from IMU 50. Processing and control unit 26 preferably selects a single guidance scenario from two guidance scenarios, referred to herein as a first guidance scenario and a second guidance scenario.

When the first guidance scenario is selected, unit 26 signals wings 28 to erect and maneuver munition 10 responsively, at least in part, to relative location data received from target identification unit 36. Optionally in this scenario, the expected location of the target (as received via interface 48) is not used for determining how to maneuver munition 10. Yet, in some embodiments, the expected location of the target is used for timing the erection of wings 28 as further detailed hereinunder.

When a second guidance scenario is selected, unit 26 signals wings 28 to erect and maneuver munition 10 responsively only to relative location data received from GPS 42. Optionally in this scenario, relative location data from unit 36 is not used by unit 26 for determining whether or not to erect wings 28 and how to maneuver munition 10.

The present inventors contemplate several criteria for determining whether the first or second guidance scenario is selected. In some embodiments of the present invention processing and control unit 26 selects the first guidance scenario if a positive identification signal is received from target identification unit 36 within a predetermined time-of-flight. Thus, in these embodiments, unit 26 comprises or is associated with a clock (not shown) which facilitates measuring the elapsed time from the launching of munition 10. If target identification unit 36 generates a positive identification signal (e.g., following a detection of the illumination coming from an optical mark) when the elapsed time is less a predetermined time-of-flight threshold, then unit 26 selects the first scenario, and if no positive identification signal is arrived before the elapsed time equals the predetermined time-of-flight threshold then unit 26 selects the second scenario. The time-of-flight threshold can vary depending on the type and speed of munition 10 as well as the length of the flying path. The time-of-flight threshold can be burned into the memory of unit 26 or it can be supplied by the operator before launching (e.g., via interface 48) and stored in a memory medium 49. Typical values for the time-of-flight threshold can be from 8 seconds to 120 seconds.

In some embodiments of the present invention processing and control unit 26 selects the first guidance scenario if the positive identification signal is received from target identification unit 36 while an estimated distance between munition 10 and the target is above a predetermined distance threshold. Thus, in these embodiments, unit 26 estimates the distance to the target. If target identification unit 36 generates the positive identification signal when the distance to the target is above the predetermined distance threshold, then unit 26 selects the first scenario, and if no positive identification signal is arrived by the time the estimated distance to the target equals the predetermined distance threshold then unit 26 selects the second scenario.

The distance to target can be estimated based on the expected location of the target and data pertaining to the location of munition 10 during flight as provided by GPS 42 and/or IMU 50. Thus, in this embodiment, the timing of erection is partially based on the expected location of the target.

In some embodiments of the present invention processing and control unit 26 selects the first guidance scenario if the positive identification signal is received from target identification unit 36 while an estimated remaining time until impact is above a predetermined impact time threshold. Thus, in these embodiments, unit 26 estimates the remaining flight time until impact. If target identification unit 36 generates the positive identification signal when the remaining flight time is above the predetermined impact time threshold, then unit 26 selects the first scenario, and if no positive identification signal is arrived by the time the estimated remaining flight time equals the predetermined impact time threshold then unit 26 selects the second scenario.

The remaining flight time until impact can be estimated based on the expected location of the target, the speed (e.g., average speed) of munition 10 and data pertaining to the location of munition 10 during flight as provided by GPS 42 and/or IMU 50. Thus, in this embodiment, the timing of erection is partially based on the expected location of the target.

Reference is now made to FIGS. 3A-G which are schematic illustrations of the relation between system 20 and munition 10, according to some embodiments of the present invention.

Figure 3A:
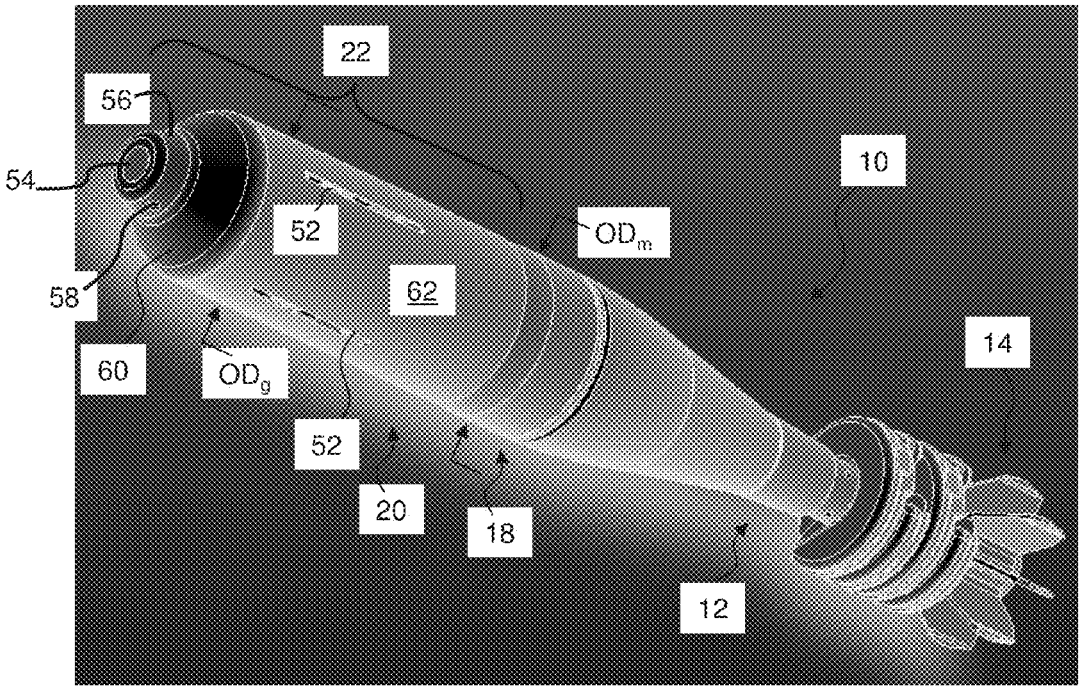
FIGS. 3A, 3B, 3C, 3D, 3E, 3F, 3G, and 3H are schematic illustrations of relations between the guidance system and the munition, according to some embodiments of the present invention.

FIG. 3A illustrates a perspective view of system 20 once mounted on munition 10. The enclosure 22 of system 20 is generally tubular with an internal cavity (not shown, see FIGS. 3E) which is adapted for receiving munition 10, optionally and preferably nose 16 thereof. In various exemplary embodiments of the invention the outer diameter $OD_g$ of enclosure 22 is at most the largest outer diameter $OD_m$ of munition 10. This embodiment is particularly useful when munition 10 is a barrel-expelled munition since it does not requires a modification of the barrel. Thus, the operator can used the same barrel for expelling munition 10 without system 20 and for expelling munition 10 while system 20 is mounted thereon.

In some embodiments of the present invention enclosure 22 comprises a sleeve 62 and a cap 60 for completing the encapsulation at the nose side.

Enclosure 22 is typically mounted on nose 16 (not shown, see FIGS. 1 and 3B-E) and optionally part of main body section 18. In the exemplified illustration of FIG. 3A enclosure 22 completely covers nose 16, but this need not necessarily be the case, since, for some type of munitions, it may not be necessary for the enclosure to completely cover nose 16. In the present embodiments, enclosure 22 also comprises an enclosure nose assembly 56 at the front side of enclosure 22. A window 54 can be provided at the tip of nose assembly 56 through which the optical sensor or sensor array 40 of unit 36 (not shown, see FIG. 2) receives optical information, preferably via optics 38. Enclosure 22 is provided with slots 52 through which wings 28 (not shown, see FIG. 3G) are erected. Typically, four slots are provided (only two are illustrated in the perspective view of FIG. 3A) for respective four wings.

In some embodiments, enclosure 22 is provided with anchoring points 58 so as to allow extraction of munition from the barrel, e.g., in case of misfire or aborting fire.

Figure 3B:
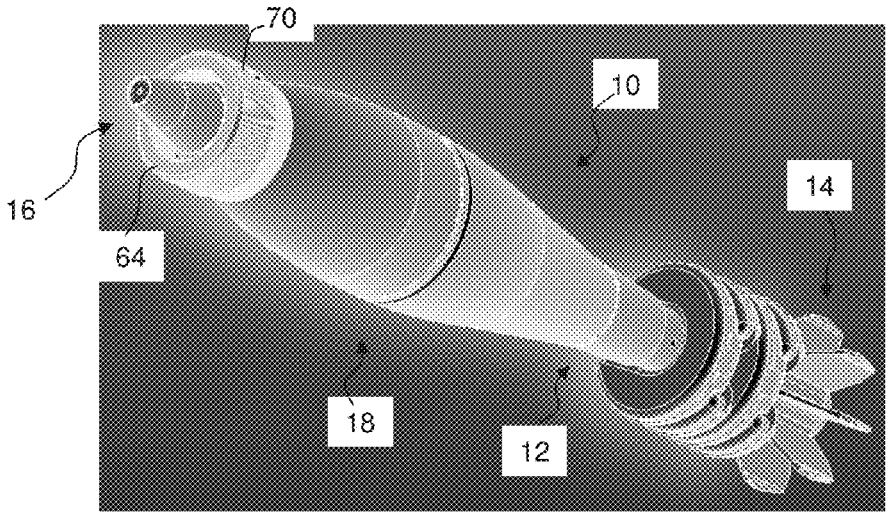
Figure 3C:
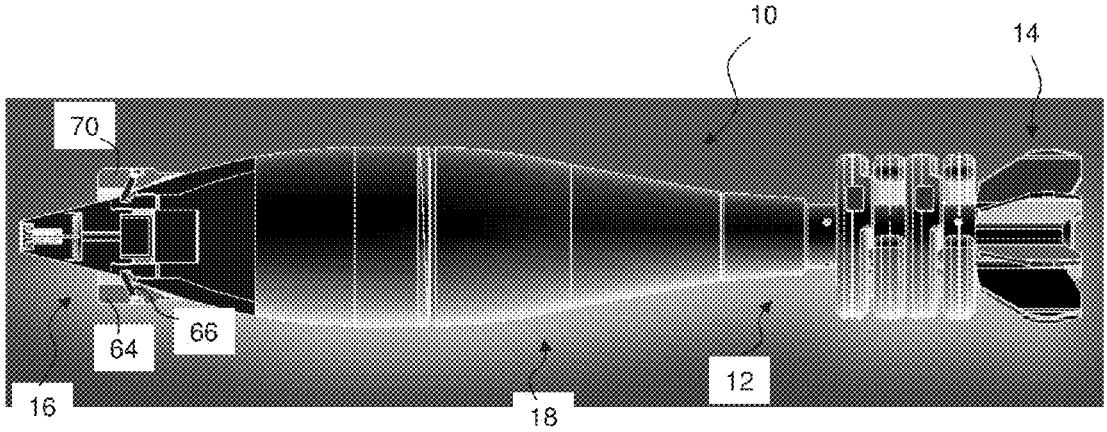
Figure 3D:
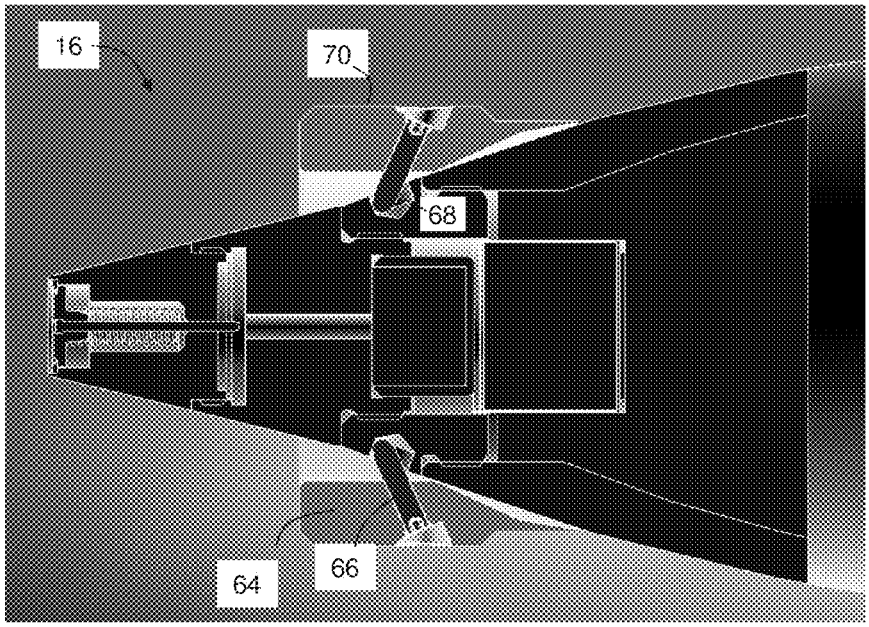

In various exemplary embodiments of the invention system 20 comprises an adaptor device 64 which facilitates the attachment of system 20 to munition 10. Adaptor device 64 is illustrated in FIGS. 3B-D. FIG. 3B illustrates a perspective view, and FIG. 3C illustrates a combined perspective/cross-sectional view of adaptor device 64 once mounted on munition 10, where in FIG. 3C the main body section 18, tail 12 and fins 14 of munition 10 are shown in perspective view whereas nose 16 and adaptor 64 are shown in a cross-sectional view. An enlarged cross-sectional view of nose 16 and adaptor 64 is illustrated in FIG. 3D. In the illustrated embodiment, adaptor 64 is generally shaped as a ring wherein part of nose 16 occupies the internal volume of the ring. In various exemplary embodiments of the invention adaptor 64 has a protruding member 66, which may be, for example, in the form of one or more pins, that is compatible with a recess 68 in munition 10. Typically, recess 68 already exists in munition 10 (e.g., as an anchor for a gripping tool which screws the fuse adaptor, or gripping tool which is used for pulling the munition out of the barrel in case of miss fire). Thus, there is no need to make any structural modifications in munition 10 to facilitate the attachment of adaptor 64 to nose 16.

The protruding member 66 is preferably urged outwardly against recess 68 to facilitate firm attachment between adaptor 64 and nose 16. This can be achieved by an appropriate elastic mechanism (e.g., a spring) as known in the art.

Figure 3E:
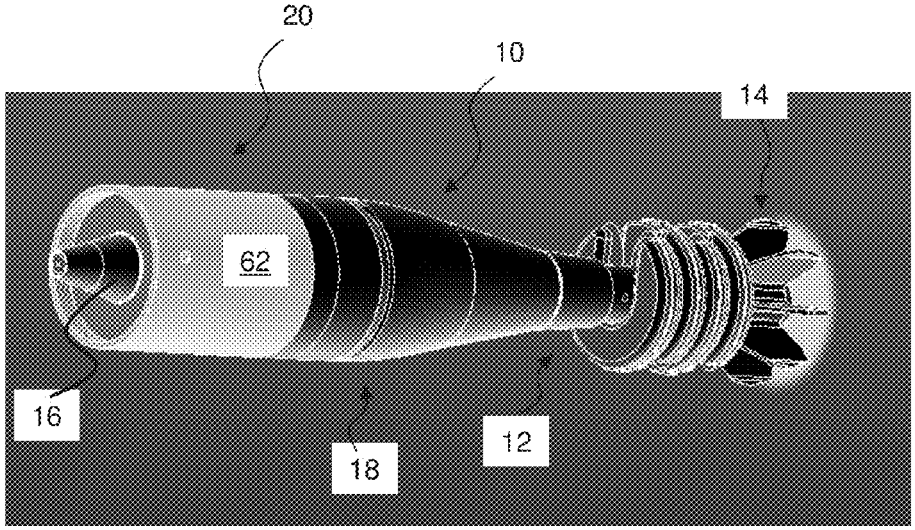

The outer surface 70 of adaptor 64 is shape-wise compatible with the inner surface of enclosure 22, thereby allowing mounting enclosure 22 onto adaptor 64. FIGS. 3E and 3H are schematic illustrations of a perspective view (FIG. 3E) and a cross-sectional view (FIG. 3H) of munition 10 once sleeve 62 is mounted on adaptor 64. Upon hitting the target, front nose assembly 56 collapses backward and pushes an internal impact rod 75 which is attached to nose assembly 56. Rod 75 impacts fuse 16 of munition 10, thereby triggering the impact sensor in fuse 16 and generating the explosion.

Figure 3F:
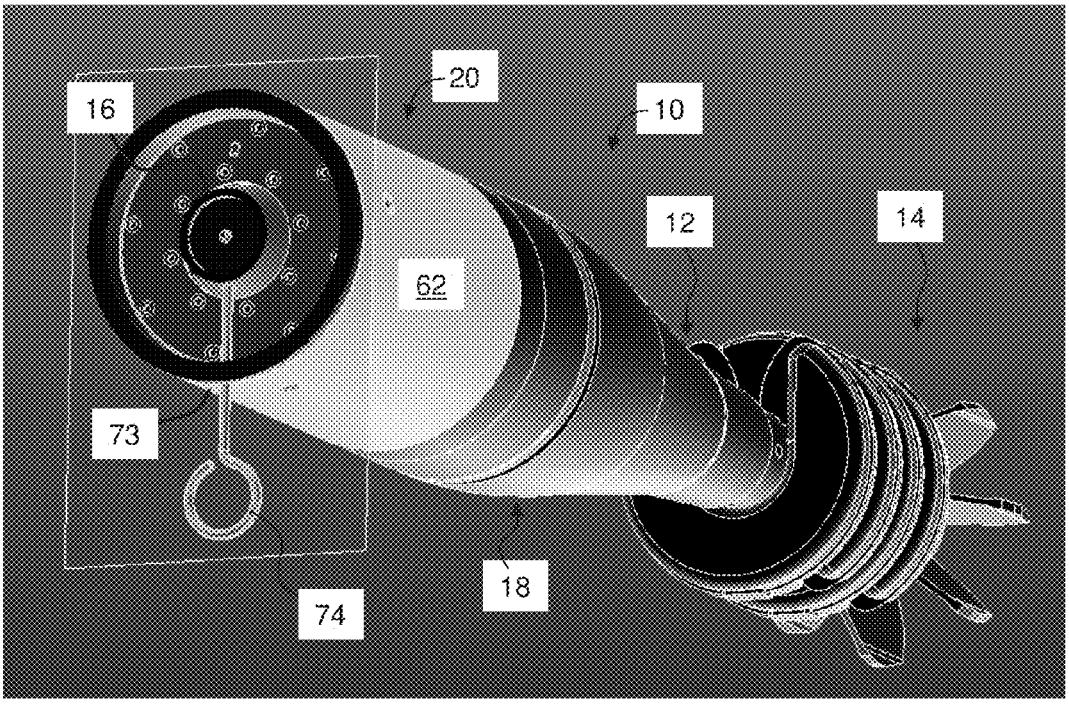
Figure 3G:
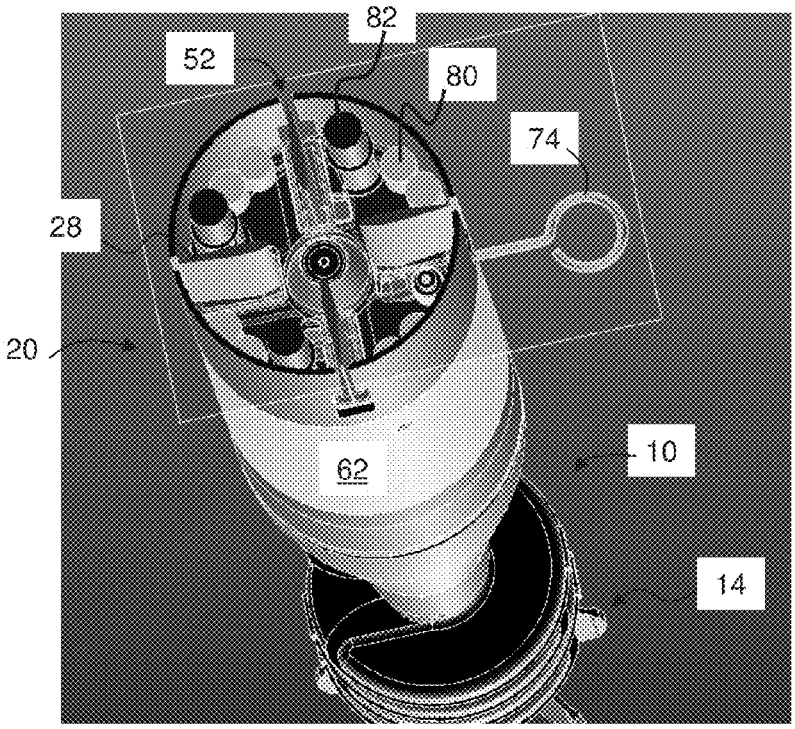
Figure 3H:
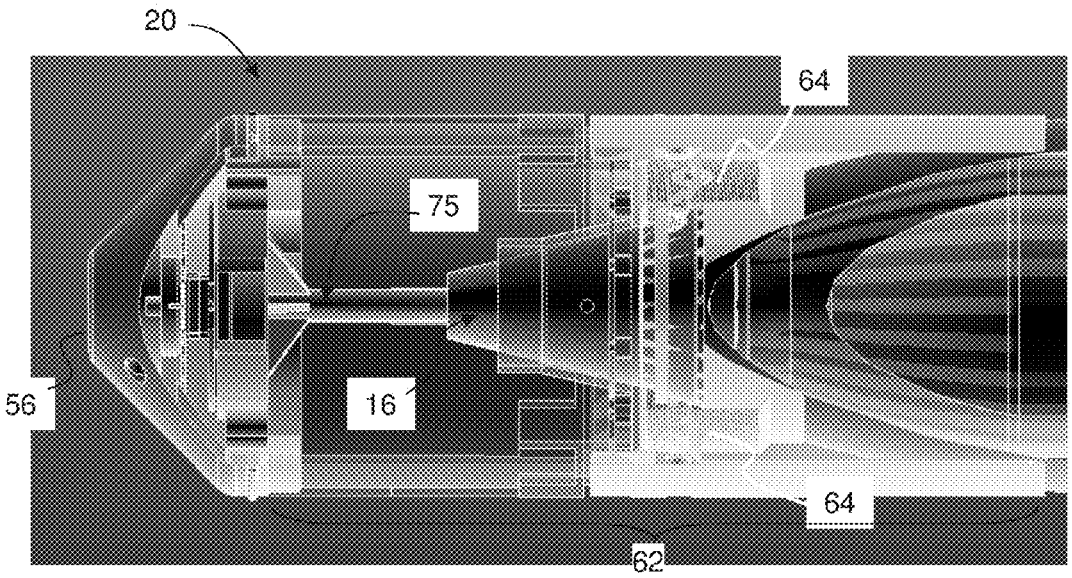

FIGS. 3F and 3G are schematic illustrations of perspective views of the anterior of sleeve 62, as viewed from planar cuts below (FIG. 3F) and above (FIG. 3G) wings 28. The respective planar cuts are illustrated as transparent planes. Munition 10 is typically provided with a safety pin 74 for preventing fuse 16 of munition 10 from being triggered during transpiration and handling. Prior to the assembling of system 20 onto munition 10, safety pin 74 is removed. After the assembling, a new safety pin can optionally and preferably be introduced back in through an opening 73 formed in sleeve 62. Prior to firing, the safety pin is removed.

FIG. 3G illustrates a non-limiting configuration in which the front section of system 20 includes power sources 80 and motors 82 for erecting wings 28. Shown in FIG. 3G are four motors 82, one motor for each wing 28, wherein each motor is powered by a pair of power sources 80. Other configurations (e.g., use of one motor to erect two or more wings, or use of a different number of power source units) are not excluded from the scope of the present invention.

System 20 can be assembled on many types of munitions. In some embodiments of the present invention system 20 is adapted to be assembled on a passive projectile such as, but not limited to, as a mortar shell or a ballistic round, or a shoulder fired rocket. A representative example is a 120 mm mortar shell, e.g., the 120 mm mortar shell manufactured by Soltam, Israel under the trade name K6 or M120. The system of the present embodiments can also be adapted for being assembled onto a barrage rocket of any size.

As used herein the term "about" refers to ±10%.

The word "exemplary" is used herein to mean "serving as an example, instance or illustration." Any embodiment described as "exemplary" is not necessarily to be construed as preferred or advantageous over other embodiments and/or to exclude the incorporation of features from other embodiments.

The word "optionally" is used herein to mean "is provided in some embodiments and not provided in other embodiments." Any particular embodiment of the invention may include a plurality of "optional" features unless such features conflict.

The terms "comprises", "comprising", "includes", "including", "having" and their conjugates mean "including but not limited to".

The term "consisting of" means "including and limited to".

The term "consisting essentially of" means that the composition, method or structure may include additional ingredients, steps and/or parts, but only if the additional ingredients, steps and/or parts do not materially alter the basic and novel characteristics of the claimed composition, method or structure.

As used herein, the singular form "a", "an" and "the" include plural references unless the context clearly dictates otherwise. For example, the term "a compound" or "at least one compound" may include a plurality of compounds, including mixtures thereof.

Throughout this application, various embodiments of this invention may be presented in a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 3, 4, 5, and 6. This applies regardless of the breadth of the range.

Whenever a numerical range is indicated herein, it is meant to include any cited numeral (fractional or integral) within the indicated range. The phrases "ranging/ranges between" a first indicate number and a second indicate number and "ranging/ranges from" a first indicate number "to" a second indicate number are used herein interchangeably and are meant to include the first and second indicated numbers and all the fractional and integral numerals therebetween.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting.

What is claimed is:

1. A munition guidance system, comprising:

a generally tubular enclosure, having an internal cavity adapted for receiving a munition, wherein an outer diameter of said enclosure is at most the largest outer diameter of said munition;

a plurality of guidance wings enclosed within said enclosure and configured for being erected outwardly from said enclosure;

a target identification unit for identifying a target; and a processing and control unit enclosed within said enclosure and being configured for erecting said wings based on at least one criterion, and for controlling said guidance wings so as to maneuver said munition while flying;

wherein said at least one criterion is at least one of: (i) time of flight of said munition, (ii) positive identification signal received from said target identification unit, and (iii) relative location data received from said target identification unit.

2. The system according to claim 1, being in a separate packing from said munition.

3. The system according to claim 1, further comprising an adaptor device having a protruding member compatible with a recess in said munition and an outer surface compatible with an inner surface of said enclosure.

4. The system according to claim 1, wherein said processing and control unit is configured for signaling said wings to maneuver said munition during flight responsively to target identification data received from said target identification unit.

5. The system according to claim 1, wherein said target identification unit comprises an optical identification unit.

6. The system according to claim 1, further comprising a global positioning system (GPS) for determining a location of said munition during flight, said GPS being associated with a data interface for receiving from an external source location data pertaining to an expected location of a target, and being configured for calculating expected relative location data based on said location of said munition and said expected location of said target.

7. The system according to claim 6, further comprising said guidance wings, wherein said guidance wings are enclosed within said enclosure and configured for being erected outwardly from said enclosure, and wherein said processing and control unit is configured for signaling said wings to erect and maneuver said munition during flight toward said target based on said relative location data.

8. The system according to claim 1, further comprising an inertial measurement unit (IMU) configured for sensing kinematic data pertaining to motion of said munition, wherein said processing and control unit is configured for processing said kinematic data to estimate a location of said munition during flight.

9. The system according to claim 1, wherein said enclosure comprises an opening for allowing an operator to access a safety element in said munition.

10. The system according to claim 1, wherein said enclosure comprises a collapsing member for triggering an impact fuse in said munition upon impact.

11. The system according to claim 1, wherein said processing and control unit is configured for detonating a warhead in said munition when said munition approaches a target.

12. The system according to claim 1, wherein said munition is a mortar shell.

13. A munition guidance system, comprising:

a generally tubular enclosure, having an internal cavity adapted for receiving a munition, wherein an outer diameter of said enclosure is at most the largest outer diameter of said munition;

a plurality of guidance wings enclosed within said enclosure and configured for being erected outwardly from said enclosure;

a target identification unit for identifying a target;

a global positioning system (GPS) for determining a location of said munition during flight, said GPS being associated with a data interface for receiving from an external source location data pertaining to an expected location of a target, and being configured for calculating expected relative location data based on said location of said munition and said expected location of said target; and a processing and control unit enclosed within said enclosure and being configured for erecting said wings based on at least one criterion, and for controlling said guidance wings so as to maneuver said munition while flying;

wherein said at least one criterion comprises at least one of: (i) time of flight of said munition, (ii) positive identification signal received from said target identification unit, (iii) (iii) relative location data received from said target identification unit, and (iv) relative location data received from said GPS.

14. The system according to claim 13, wherein said processing and control unit is configured for selecting a single guidance scenario from the group consisting of: a first guidance scenario in which said erecting and said maneuvering is responsive to relative location data received from said target identification unit, and a second guidance scenario in which said erecting and said maneuvering is responsive to relative location data received from said GPS but not from said target identification unit.

15. The system according to claim 14, wherein said processing and control unit is configured for selecting said first guidance scenario if a positive identification signal is received from said target identification unit within a predetermined time of flight.

16. The system according to claim 14, wherein said processing and control unit is configured for selecting said first guidance scenario if a positive identification signal is received from said target identification unit while an estimated distance to said target is above a predetermined distance threshold.

17. The system according to claim 14, wherein said processing and control unit is configured for selecting said first guidance scenario if a positive identification signal is received from said target identification unit while an estimated remaining time until impact is above a predetermined impact time threshold.

18. A method of assembling a guided munition, comprising mounting a munition guidance system on a munition, said munition guidance system comprising:

an generally tubular enclosure, having an internal cavity adapted for receiving a munition, wherein an outer diameter of said enclosure is at most the largest outer diameter of said munition;

a plurality of guidance wings enclosed in said enclosure and configured for being erected outwardly from said enclosure;

a target identification unit for identifying a target; and a processing and control unit enclosed within said enclosure and being configured for erecting said wings based on at least one criterion, and for controlling said guidance wings so as to maneuver said munition while flying;

wherein said at least one criterion is at least one of: (i) time of flight of said munition, (ii) positive identification signal received from said target identification unit, and (iii) relative location data received from said target identification unit.

* * * * *